US009833926B2

(12) United States Patent
Krentz

(10) Patent No.: US 9,833,926 B2
(45) Date of Patent: Dec. 5, 2017

(54) CONCRETE PRODUCT MACHINE VIBRATOR-MOLD INTERFACE

(71) Applicant: Besser Company, Alpena, MI (US)

(72) Inventor: Douglas Krentz, Alpena, MI (US)

(73) Assignee: Besser Company, Alpena, MI (US)

( * ) Notice: Subject to any disclaimer, the term of this patent is extended or adjusted under 35 U.S.C. 154(b) by 0 days.

(21) Appl. No.: 15/238,771

(22) Filed: Aug. 17, 2016

(65) Prior Publication Data

US 2017/0050336 A1 Feb. 23, 2017

Related U.S. Application Data

(60) Provisional application No. 62/206,364, filed on Aug. 18, 2015.

(51) Int. Cl.

| | |
|---|---|
| ***B28B 1/08*** | (2006.01) |
| ***B28B 1/087*** | (2006.01) |
| ***B06B 1/16*** | (2006.01) |

(52) U.S. Cl.

CPC ..... *B28B 1/0873* (2013.01); *B06B 1/16* (2013.01)

(58) Field of Classification Search

CPC ..... B28B 1/0873; B06B 1/16

See application file for complete search history.

(56) References Cited

U.S. PATENT DOCUMENTS

| | | | | |
|---|---|---|---|---|
| 3,348,278 | A * | 10/1967 | Jankovsky | B28B 1/0873 264/69 |
| 3,583,683 | A * | 6/1971 | Kleiber | B28B 1/0873 366/114 |
| 3,899,281 | A * | 8/1975 | Jakobs | B28B 1/0873 181/113 |
| 9,427,887 | B2 * | 8/2016 | Krentz | B28B 1/0873 |

* cited by examiner

*Primary Examiner* — James MacKey

(74) *Attorney, Agent, or Firm* — Reising Ethington P.C.

(57) ABSTRACT

A concrete product machine comprising a vibrator assembly and a mold assembly. The vibrator assembly includes a vibrator shaft supported for rotation by a vibrator bearing set carried by a vibrator bearing housing. The mold assembly is carried by the vibrator assembly and includes a concrete product mold carried by a mold support member. The mold support member is carried by the vibrator bearing housing. A mold assembly support joint comprises first and second support surfaces of the vibrator bearing housing engaging respective first and second support surfaces of the mold support member in a tapered fit.

9 Claims, 5 Drawing Sheets

CONCRETE PRODUCT MACHINE VIBRATOR-MOLD INTERFACE

CROSS-REFERENCE TO RELATED APPLICATIONS

This is a non-provisional patent application claiming the benefit of the filing date of U.S. Provisional Patent Application Ser. No. 62/206,364, which was filed Aug. 18, 2015, and which is incorporated herein by reference in its entirety.

STATEMENT REGARDING FEDERALLY SPONSORED RESEARCH OR DEVELOPMENT

Not Applicable

BACKGROUND

Field

This application relates generally to a concrete product machine and, more specifically, to such a machine that imparts vibration to a concrete product mold.

Description of Related Art Including Information Disclosed Under 37 CFR 1.97 and 1.98

It is known for concrete product machines to include concrete molds and vibrator assemblies that impart vibration to the concrete molds. It is also known for interfacing surfaces of joints between concrete molds and vibrator assemblies tend to distort over time, loosening the joints and degrading performance.

SUMMARY

A concrete product machine comprising a vibrator assembly comprising a vibrator shaft supported for rotation about a vibrator shaft axis by a first vibrator bearing set carried by a first vibrator bearing housing. A mold assembly is carried by the vibrator assembly and comprises a concrete product mold carried by a first mold support member. The first mold support member is carried by the first vibrator bearing housing. A first mold assembly support joint comprises first and second support surfaces of the first vibrator bearing housing engaging respective first and second support surfaces of the first mold support member in a tapered fit.

DRAWING DESCRIPTIONS

DETAILED DESCRIPTION

Figure 3:
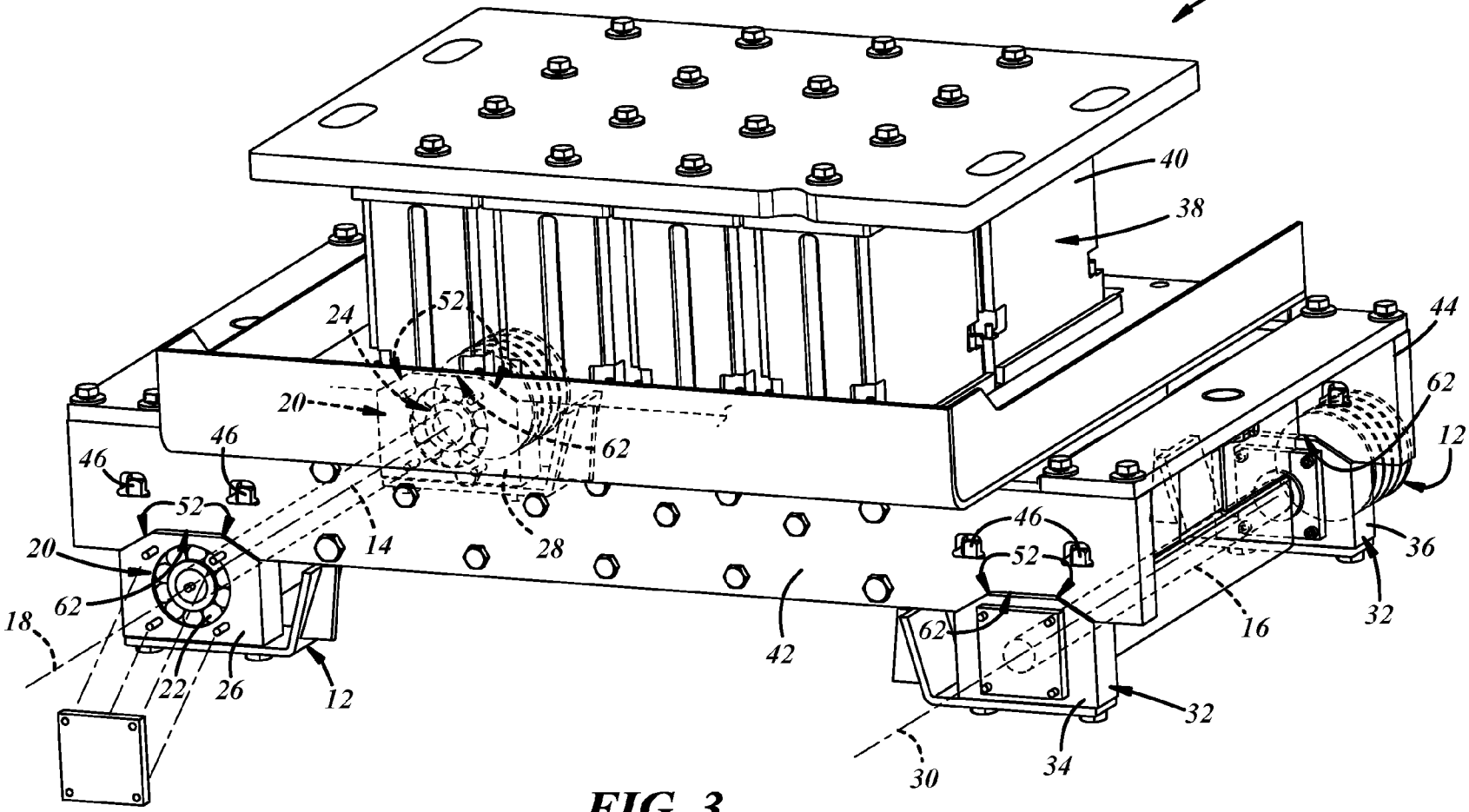
FIG. 3 is an orthogonal view of the concrete product machine of FIG. 1.
Figure 4:
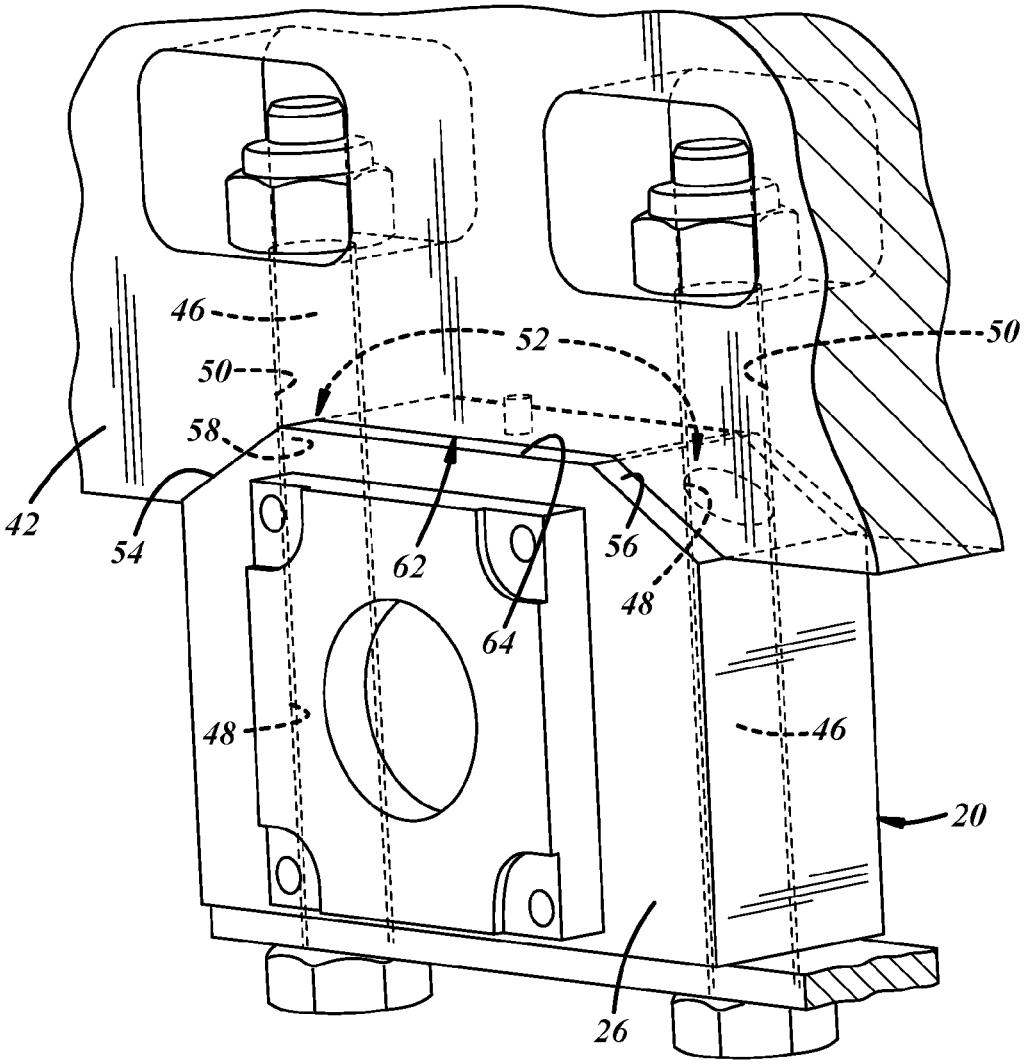
FIG. 4 is an orthogonal fragmentary view of a vibrator bearing housing of the concrete product machine of FIG. 1 received in a housing-receiving pocket of a mold support member of the concrete product machine.
Figure 7:
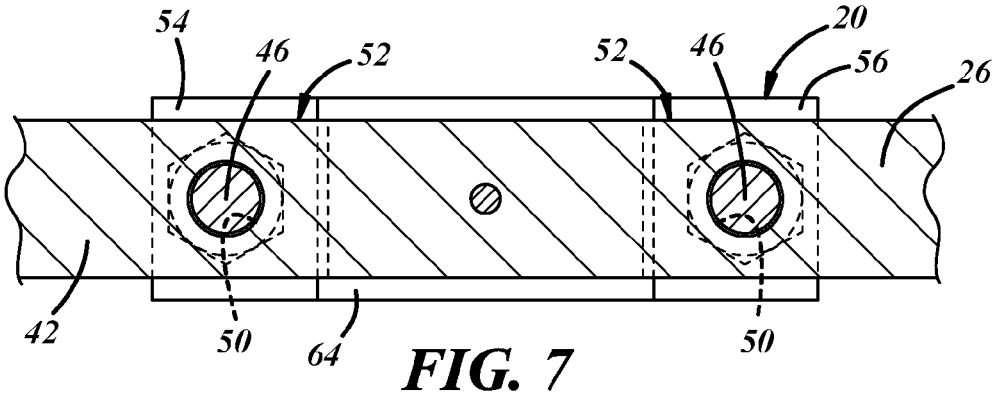
FIG. 7 is a cross-sectional view of the vibrator bearing housing and mold support member of FIG. 4 taken along line 7-7 of FIG. 5.

A concrete product machine, generally shown at 10 in the drawings, comprises a vibrator assembly 12 including first and second vibrator shafts 14, 16. As shown in FIG. 3, the first vibrator shaft 14 may be supported for rotation about a first vibrator shaft axis 18 on a first vibrator bearing pair 20 comprising axially-spaced forward and aft vibrator bearing sets 22, 24 carried by fore and aft vibrator bearing housings 26, 28. As is also shown in FIG. 3, the second vibrator shaft 16 may be supported for rotation about a second vibrator shaft axis 30 on a second vibrator bearing pair 32 that, like the first vibrator bearing pair 20, comprises axially-spaced forward and aft vibrator bearing sets (not shown) carried by forward and aft vibrator bearing housings 34, 36.

Figure 1:
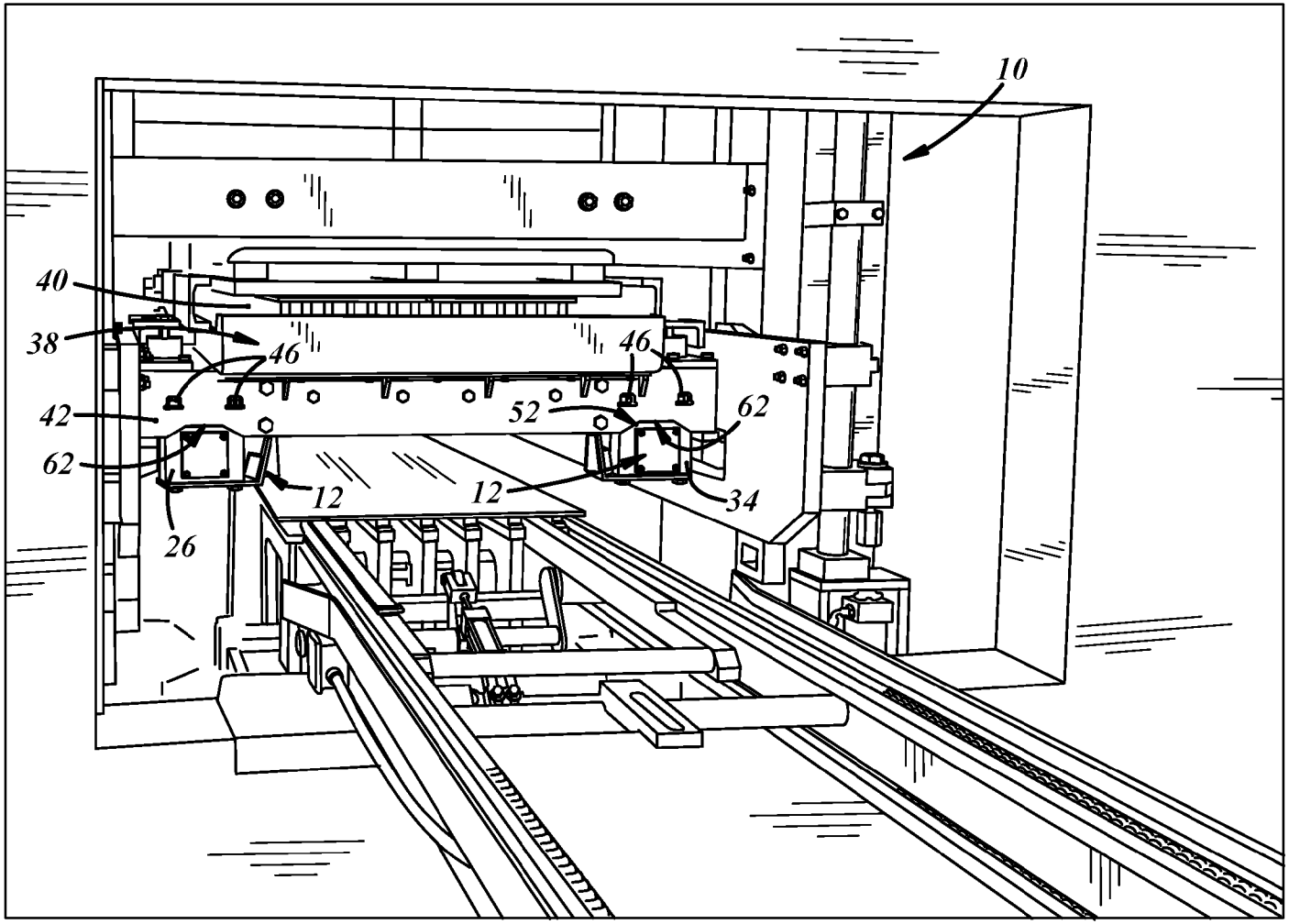
FIG. 1 is a perspective view of a concrete product machine.
Figure 2:
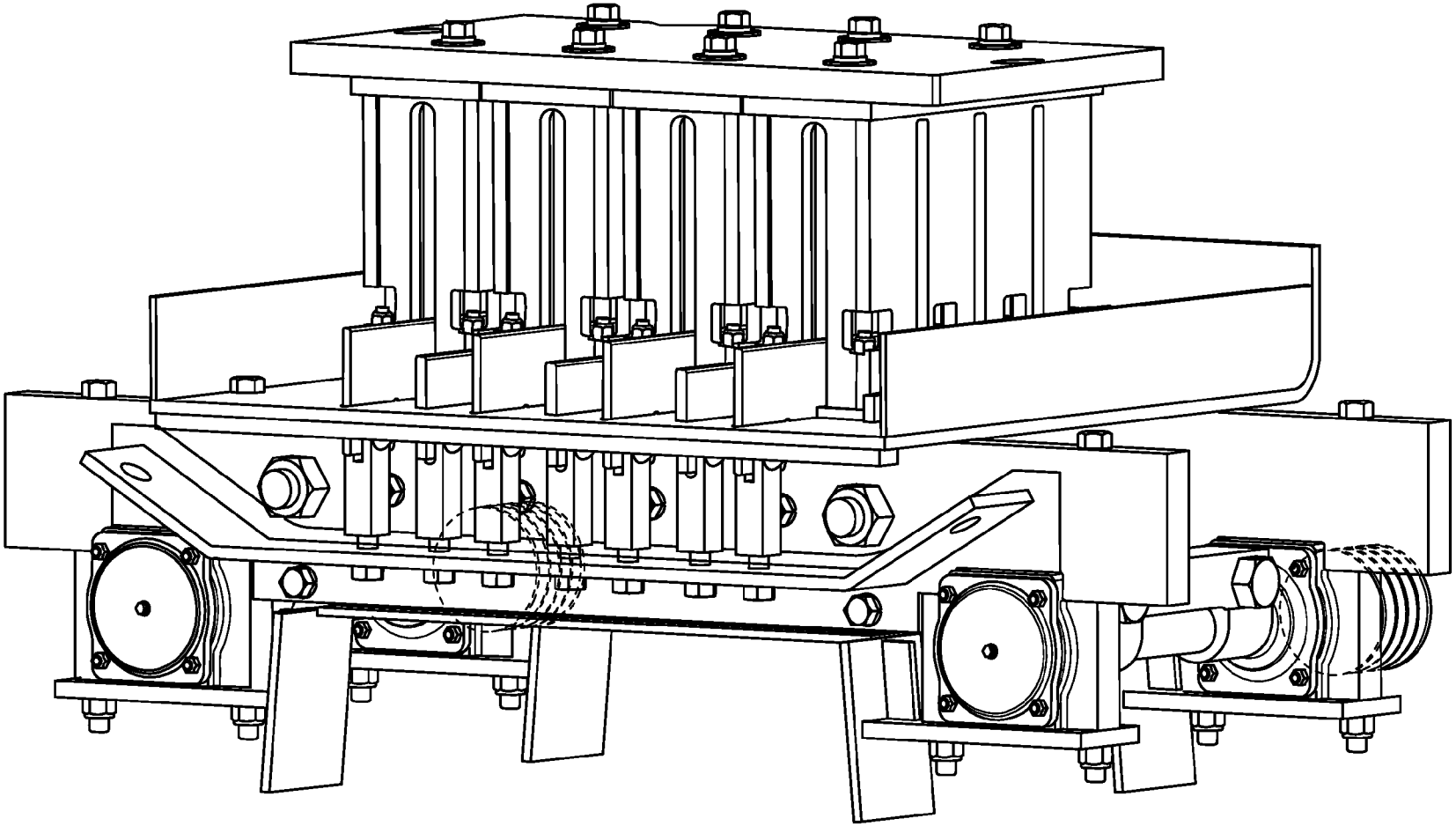
(Prior Art) FIG. 2
FIG. 2 is an orthogonal view of a prior art concrete product machine.

As shown in FIGS. 1 and 3, the machine 10 includes a mold assembly 38 that is carried by the vibrator assembly 12 and that includes a concrete product mold 40 carried by forward and aft mold support members 42, 44. As shown in FIG. 3, the forward mold support member 42 may be carried by the forward vibrator bearing housings 26, 34 of the first and second vibrator bearing pairs 20, 32. The aft mold support member 44 may be carried by the aft vibrator bearing housings 28, 36 of the first and second vibrator bearing pairs 20, 32.

As is best shown in FIGS. 4-7, fasteners 46 may extend through two housing through-holes 48 formed in each of the vibrator bearing housings 26, 28, 34, 36 and may also extend through support member through-holes 50 formed in the mold support members 42, 44 to fasten the forward vibrator bearing housings 26, 34 to the forward mold support member 42 and the aft vibrator bearing housings 28, 36 to the aft mold support member 44.

Figure 5:
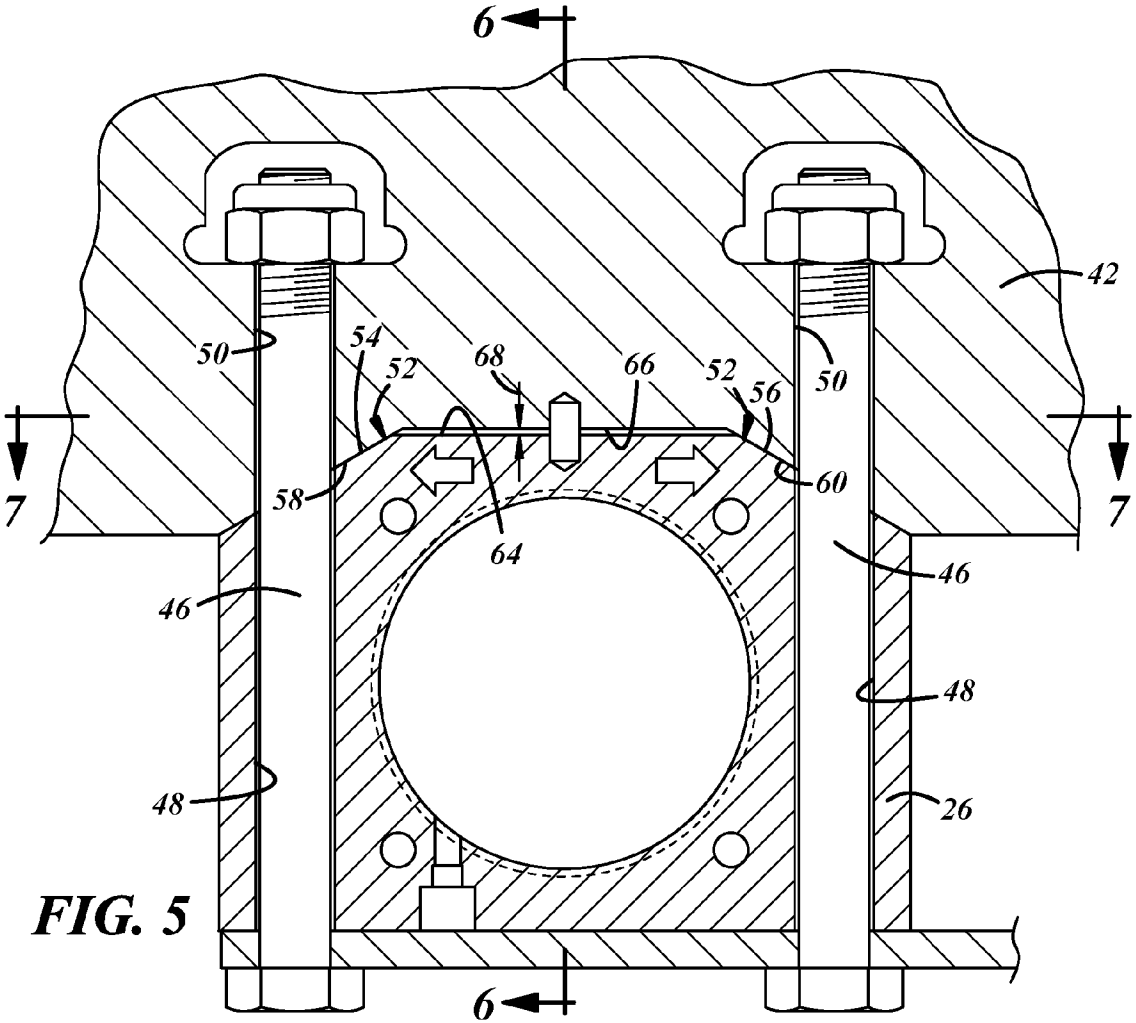
FIG. 5 is cross-sectional front view of the vibrator bearing housing and mold support member of FIG. 4.

The machine 10 may also include four mold assembly support joints 52. As best shown in FIG. 5, each of the four mold assembly support joints 52 may comprise first and second support surfaces 54, 56 of one of the vibrator bearing housings 26, 28, 34, 36 engaging respective first and second support surfaces 58, 60 of one of four bearing housing receiving pockets 62, two of which are formed in each of the mold support members 42, 44 in a tapered fit.

As best shown in FIGS. 3 and 5, the first and second support surfaces 54, 56 of each of the vibrator bearing housings 26, 28, 34, 36 may be disposed in a diagonally outward and upward facing orientation relative to one another and to earth gravity, respectively. Likewise, the first and second support surfaces 58, 60 of each bearing housing receiving pocket 62 may be disposed in a diagonally inward and downward facing orientation relative to one another and earth gravity, respectively.

In other words, the first support surface 54 of each of the vibrator bearing housings 26, 28, 34, 36 may be angled relative to the second support surface 56 of each of the vibrator bearing housings 26, 28, 34, 36 such that respective upper ends of the first and second support surfaces 54, 56 of each of the vibrator bearing housings 26, 28, 34, 36 are disposed closer to one another than respective lower ends of the first and second support surfaces 54, 56 of each of the vibrator bearing housings 26, 28, 34, 36. Likewise, the first support surface 58 of each bearing housing receiving pocket 62 may be angled relative to the second support surface 60 of each bearing housing receiving pocket 62 such that respective upper ends of the first and second support surfaces 54, 56 of each bearing housing receiving pocket 62 are disposed closer to one another than respective lower ends of the first and second support surfaces 54, 56 of each bearing housing receiving pocket 62.

The first support surface 54 of each of the vibrator bearing housings 26, 28, 34, 36 and the second support surface 56 of each of the vibrator bearing housings 26, 28, 34, 36 may subtend an angle in the range of 1-179 degrees, and, as shown in the drawings, may preferably subtend an angle of approximately 120 degrees. The first support surface 58 of each bearing housing receiving pocket 62 of each mold support member 42, 44, and the second support surface 56 of each bearing housing receiving pocket 62 of each mold support member 42, 44 subtend an angle in the range of 1-179 degrees, and preferably subtend an angle of approximately 120 degrees.

The first support surface 54 of one or more of the vibrator bearing housings 26, 28, 34, 36 may be angled within the range of 1-89° relative to an upward-facing top surface 64 of that vibrator bearing housing. Likewise, the first support surface 58 of one or more of the bearing housing-receiving pockets 62 may also be angled within the range of 1-89° relative to a downward-facing upper pocket surface 66 of the or each bearing housing receiving pocket 62.

As best shown in FIG. 5, the first support surface 54 of one or more of the vibrator bearing housings 26, 28, 34, 36 may preferably be angled 60° relative to the second support surface 56 of that vibrator bearing housing as shown in the drawings. Likewise, and as is also best shown in FIG. 5, the first support surface 58 of one or more of the bearing housing receiving pockets 62 may preferably be angled 60° relative to the second support member support surface of the or each pocket 62.

As is also best shown in FIG. 5, the first and second angled support surfaces 54, 56 of one or more of the vibrator bearing housings 26, 28, 34, 36 may each preferably be angled 30° relative to the upward-facing top surface 64 of the or each vibrator bearing housing. Likewise, the first and second angled support surfaces of one or more of the bearing housing-receiving pockets 62 may each preferably be angled 30° relative to the downward-facing upper pocket surface 66 of the or each bearing housing-receiving pocket 62.

Figure 6:
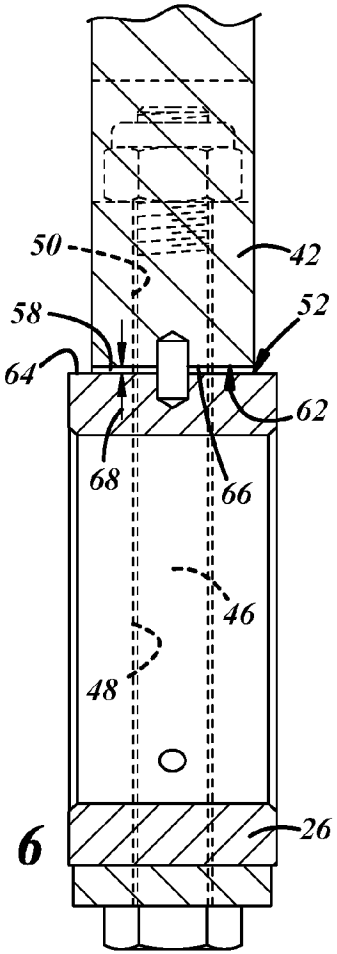
FIG. 6 is a cross-sectional view of the vibrator bearing housing and mold support member of FIG. 4 taken along line 6-6 of FIG. 5.

As best shown in FIGS. 5 and 6, there may be a gap 68 between an upward-facing top surface 64 of each vibrator bearing housing and a downward-facing upper pocket surface 66 of each bearing housing-receiving pocket 62. The upward-facing top surface 64 of each vibrator bearing housing may extend between upper ends of the angled support surfaces 54, 56 of the vibrator bearing housing, and the downward-facing surface at the top of each housing-receiving pocket 62 may extend between upper ends of the angled support surfaces of each pocket 62.

The upward-facing top surface 64 of each of the vibrator bearing housings 26, 28, 34, 36 and the downward-facing upper pocket surface 66 of each pocket 62 may be spaced from one another when the vibrator bearing housings 26, 28, 34, 36 are received in the bearing housing-receiving pockets 62 and the angled support surfaces 54, 56 of the vibrator bearing housings 26, 28, 34, 36 are engaging the respective angled support surfaces of the pockets 62. The presence of the gap 68, i.e., the spacing between the downward and upward-facing surfaces 64, 66, insures that mold loads are carried by the angled support surfaces 54, 56 of the vibrator bearing housings 26, 28, 34, 36 and receiving pockets 62 rather than by the upward-facing vibrator bearing housing top surfaces 64 and the downward-facing pocket upper pocket surfaces, and that considerable wearing of the angled support surfaces 54, 56 of the vibrator bearing housings 26, 28, 34, 36 and/or housing-receiving pockets 62 would have to take place before any of the upward-facing surfaces 64 of the vibrator bearing housings 26, 28, 34, 36 and the downward-facing upper pocket surfaces 66 would come into contact with each other.

In the disclosed embodiment the initial gap measurement of the gap 68 between the upward-facing top surface 64 of each bearing housing and the downward-facing upper pocket surface 66 at the top of each bearing housing-receiving pocket 62 may be 0.129 inches. However, in other embodiments, any other suitable initial gap measurement may be used. Also, the gap measurement may decrease over time as the angled support surfaces 54, 56 of the bearing housings 26, 28, 34, 36 and bearing housing-receiving pockets 62 wear.

A concrete product machine constructed as described above, because of the tapered fit provided between the vibrator bearing housings 26, 28, 34, 36 and the mold support members 42, 44, provides and maintains a tighter connection between the vibrator assembly 12 and the mold assembly 38 than would otherwise be provided, reduces mold face wear, and prevents fastener breakage by reducing horizontal vibration.

This description, rather than describing limitations of an invention, only illustrates one embodiment of the invention recited in the claims. The language of this description is therefore exclusively descriptive and is non-limiting.

Obviously, it's possible to modify this invention from what the description teaches. Within the scope of the claims, one may practice the invention other than as described above.

What is claimed is:

1. A concrete product machine comprising:

a vibrator assembly comprising a vibrator shaft supported for rotation about a vibrator shaft axis by a first vibrator bearing set carried by a first vibrator bearing housing;

a mold assembly carried by the vibrator assembly and comprising a concrete product mold carried by a first mold support member, the first mold support member being carried by the first vibrator bearing housing; and a first mold assembly support joint comprising first and second support surfaces of the first vibrator bearing housing engaging respective first and second support surfaces of the first mold support member in a tapered fit.

2. The concrete product machine of claim 1 in which:

the first and second support surfaces of the first vibrator bearing housing are diagonally outward and upward facing relative to one another and earth gravity, respectively;

and the first and second support surfaces of the first mold support member are diagonally inward and downward facing relative to one another and earth gravity, respectively.

3. The concrete product machine of claim 2 in which:

a gap between the first vibrator bearing housing and the first mold support member is defined by an upward-facing surface of the first vibrator bearing housing and a downward-facing surface of the first mold support member;

the upward-facing surface of the first vibrator bearing housing extends between respective upper ends of the first and second support surfaces of the first vibrator bearing housing;

the downward-facing surface of the first mold support member extends between respective upper ends of the first and second support surfaces of the first mold support member; and the upward-facing surface of the first vibrator bearing housing and the downward-facing surface of the first mold support member are spaced from one another when the first and second support surfaces of the first mold support member are engaging the respective first and second support surfaces of the first vibrator bearing housing.

4. The concrete product machine of claim 1 in which:

the first and second support surfaces of the first vibrator bearing housing engage the respective first and second support surfaces of the first mold support member;

the first support surface of the first vibrator bearing housing is angled relative to the second support surface of the first vibrator bearing housing, and the first support surface of the first mold support member is angled relative to the second support surface of the first mold support member.

5. The concrete product machine of claim 1 in which:

the first and second support surfaces of the first vibrator bearing housing are outward-facing;

the first and second support surfaces of the first mold support member are inward-facing;

the first support surface of the first vibrator bearing housing is angled relative to the second support surface of the first vibrator bearing housing such that respective upper ends of the first and second support surfaces of the vibrator bearing housing are disposed closer to one another than respective lower ends of the first and second support surfaces of the first vibrator bearing housing; and the first support surface of the first mold support member is angled relative to the second support surface of the first mold support member such that respective upper ends of the first and second support surfaces of the first mold support member are disposed closer to one another than respective lower ends of the first and second support surfaces of the first mold support member.

6. The concrete product machine of claim 5 in which:

the first support surface of the first vibrator bearing housing is angled within the range of 1-179 degrees relative to the second support surface of the first vibrator bearing housing; and the first support surface of the first mold support member is angled within the range of 1-179 degrees relative to the second support surface of the first mold support member.

7. The concrete product machine of claim 6 in which:

the first support surface of the first vibrator bearing housing is angled 120 degrees relative to the second support surface of the first vibrator bearing housing; and the first support surface of the first mold support member is angled 120 degrees relative to the second support surface of the first mold support member.

8. The concrete product machine of claim 1 in which:

the vibrator shaft is supported for rotation by a second vibrator bearing set carried by a second vibrator bearing housing;

the concrete product mold is carried by a second mold support member that is carried by the second vibrator bearing housing; and the machine includes a second mold assembly support joint comprising first and second support surfaces of the second vibrator bearing housing engaging respective first and second support surfaces of the second mold support member in a tapered fit.

9. The concrete product machine of claim 8 in which:

the vibrator assembly comprises a second vibrator shaft supported for rotation about a second vibrator shaft axis by third and fourth vibrator bearing sets carried by respective third and fourth vibrator bearing housings;

the first mold support member is carried by the third vibrator bearing housing;

the second mold support member is carried by the fourth vibrator bearing housing;

the machine includes a third mold assembly support joint comprising first and second support surfaces of the third vibrator bearing housing engaging respective first and second support surfaces of the third mold support member in a tapered fit; and the machine includes a fourth mold assembly support joint comprising first and second support surfaces of the fourth vibrator bearing housing engaging respective first and second support surfaces of the fourth mold support member in a tapered fit.

* * * * *